US005842433A

United States Patent [19]

Kyle

[11] Patent Number: 5,842,433

[45] Date of Patent: Dec. 1, 1998

[54] PLASTIC PORT ASSEMBLY

[76] Inventor: James H. Kyle, 228 Darling Rd., Keene, N.H. 03431

[21] Appl. No.: 926,478

[22] Filed: Sep. 10, 1997

[51] Int. Cl.[6] ..... B63B 19/00

[52] U.S. Cl. ..... 114/173

[58] Field of Search ..... 114/173, 174, 114/175, 176, 177, 178, 201 R; 49/DIG. 2

[56] References Cited

U.S. PATENT DOCUMENTS 4,669,410 6/1987 Howell ..... 114/173

OTHER PUBLICATIONS

Marinco Catalog 1997, p. 106, Napa California, Oct. 1996.

*Primary Examiner*—Stephen Avila
*Attorney, Agent, or Firm*—David E. Dougherty, Esquire

[57] ABSTRACT

A port assembly for a marine vessel having an outer wall with an opening therein includes a shaped lens element, a pair of concentric plastic rings and a resilient gasket between the lens element and one of the rings. The plastic ring on the outside of the vessel is adjacent to the gasket and includes a pair of hinged brackets and a plurality of mounting members. A hinge assembly connects the plastic ring and lens element and allows the lens to be rotated inwardly to an open position and back to a closed position in which it is pressed against a gasket. One or more dogs are rotatably mounted on the mounting members for holding the lens element in a closed position. The second plastic ring is constructed and arranged to clamp the first ring within the opening and against the wall of the vessel. In a preferred embodiment of the invention, a decorative metal ring covers the exterior surface of the port assembly.

12 Claims, 6 Drawing Sheets

PLASTIC PORT ASSEMBLY

FIELD OF THE INVENTION

The present invention relates to a port assembly for a marine vessel, or the like, and more particularly to an improved plastic port assembly which includes a pair of concentric plastic rings. The invention also relates to a plastic port assembly which includes a decorative metal ring on an exterior thereof.

BACKGROUND FOR THE INVENTION

Cast aluminum hatch and port assemblies for marine vessels are well known. Such assemblies are commercially available from Pompanette, Inc., of Charlestown, New Hampshire, the assignee of the present invention. Such assemblies are described in my co-pending applications entitled "Marine Hatch Assembly," Ser. No. 08/583,479, filed on Jan. 5, 1996, now abandoned and "Improved Hatch Assembly for a Marine Vessel," Ser. No. 08/600,542, filed on Feb. 13, 1996, now U.S. Pat. No. 5,676,082, which are assigned to the same assignee as the present invention. Both applications are included herein in their entireties, by reference. Such assemblies typically include a cast aluminum alloy frame, an elastomeric gasket and a clear plastic cover. The cover is typically made of a clear or tinted LEXAN sheet, a product of General Electric, which is known for its high strength.

As used herein, port assemblies are differentiated from hatch assemblies by being installed in the side of a vessel, i.e., a generally vertical plane, while hatch assemblies are typically installed in a deck, i.e., in a generally horizontal surface. Furthermore, port assemblies are typically hinged inboard or inward while hatch assemblies typically open outwardly. In addition, port assemblies are provided to allow light and air to pass through the port assembly, while a hatch is commonly used for an individual and/or marine paraphernalia to pass through an opening in the deck.

Stainless steel port assemblies are also commercially available and frequently preferred for marine vessels which are used in salt water. However, such assemblies are relatively expensive and, at times, difficult to install. In addition, the commercially-available assemblies sometimes require excessive amounts of caulking and may not readily fit a variety of boats, with sidewalls of different thicknesses.

A more recent development in stainless steel port assemblies is disclosed in my co-pending U.S. patent application Ser. No. 08/746,163 which was filed on Nov. 6, 1996 now U.S. Pat. No. 5,758,593, and entitled, "PORT ASSEMBLY FOR A MARINE VESSEL". That application is also assigned to the same assignee as the present application and is incorporated herein in its entirety by reference. That port assembly disclosed in my most recent application includes three concentric stainless steel rings which are superimposed upon one another and includes a lens element and a hinge for pivotally mounting the lens element inwardly of the vessel's wall.

It is presently believed that there is a significant demand for a plastic port assembly which offers many of the advantages of the cast aluminum and stainless steel assemblies but which can be produced and installed at a lower cost. Such assemblies should be durable, relatively easy to install and remove, resistant to leakage and at the same time present a pleasing appearance. Such port assemblies should also conform to minor surface variations and hull curvatures and should be suitable for installation on vessels having walls with minor irregularities and/or differences in wall thicknesses.

A plastic port assembly in accordance with the present invention offers the aforementioned advantages and other advantages which will become obvious from reading the following disclosure. In addition, the preferred embodiment of the invention incorporates a decorative ring on an exterior thereof to provide the appearance of a more expensive stainless steel port assembly.

BRIEF SUMMARY OF THE INVENTION

In essence, the present invention contemplates a port assembly for a marine vessel having an outer wall with an opening therein. The port assembly includes a shaped lens element and a first plastic ring which surrounds the lens element and which fits within the opening in an abutting and overlapping relationship with the wall of the vessel. A hinged assembly connects the plastic ring and the lens element and allows location of the lens element with respect to the plastic ring to thereby open or close the port assembly. The first plastic ring also forms an outer surface with respect to the vessel and includes one or more rotatable dogs mounted thereon. In a preferred embodiment of the invention, a resilient gasket surrounds the first plastic ring and forms a seal between the first plastic ring and the lens element, when the lens element is in a closed position and held in sealing engagement with the gasket by one or more rotatable dogs. The port assembly also includes a second plastic ring in a concentric somewhat nesting relationship with the first plastic ring and in an abutting relationship with an interior surface of the vessel's wall. Fastening means are also provided for fastening the first and second plastic rings together in a clamping relationship with the wall of the vessel.

In the preferred embodiment of the invention, a decorative metal ring is superimposed on and covers the outer surface of the first plastic ring in a nesting relationship. Means, such as an inwardly projecting perpendicular edge and a plurality of tabs are provided for fastening the decorative ring to the outer surface of the first plastic ring.

In a further preferred embodiment of the invention, the first plastic ring with a portion thereof on the outside of the vessel includes a pair of inwardly extending (toward the interior of the vessel) walls having a generally J-shaped cross-section and an outwardly extending (away from the lens element) flange or clamping element which is generally perpendicular to the inwardly extending walls. The first plastic ring also includes a plurality of fastening elements or threaded bores which are formed integrally thereof and in an adjacent and abutting relationship with the outer (further from the lens element) inwardly extending wall. In addition, the first plastic ring also includes one or more base elements such as a threaded bore integrally formed therein in an adjacent and abutting position with respect to the inner of the inwardly extending walls. These base elements are provided as a support for one or more rotatable dogs. The second plastic ring includes an inner wall (closest to the lens element) and two outer walls. The inner and the first outer wall form a channel which accommodates the outer wall of the first plastic ring therebetween while the two outer most walls of the second plastic ring serve as a clamping member against the inner surface of the wall of the vessel. The second plastic ring also includes a plurality of corresponding fastening means such as openings for clamping the two plastic rings against a vessel wall.

The invention will now be described in connection with the accompanying drawings, wherein like reference numerals have been used to indicate like parts.

DETAILED DESCRIPTION OF THE PREFERRED EMBODIMENT OF THE INVENTION

Figure 1:
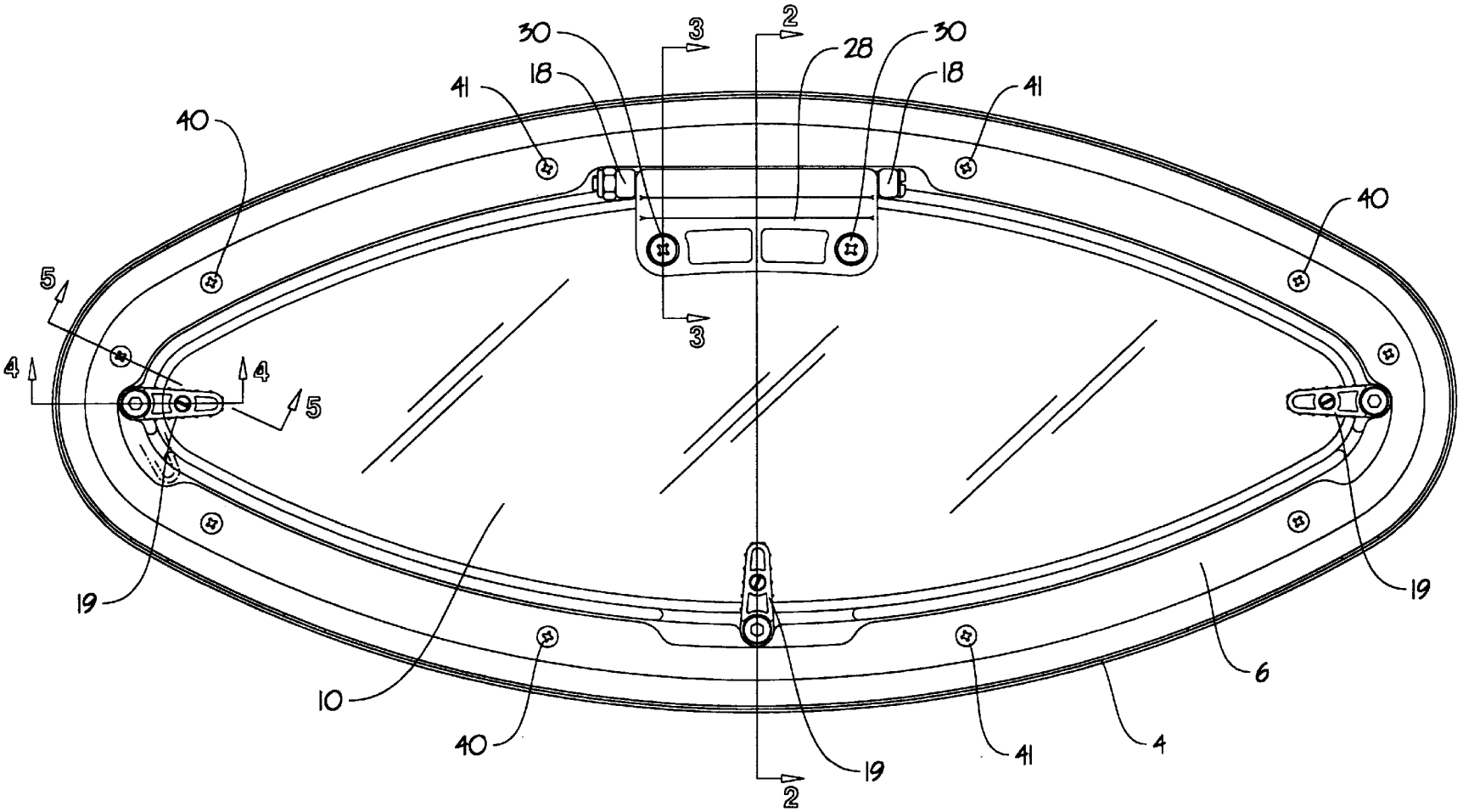
FIG. 1 is a plan view of a port assembly in accordance with a preferred embodiment of the invention as viewed when looking outwardly from the interior of the vessel.
Figure 2:
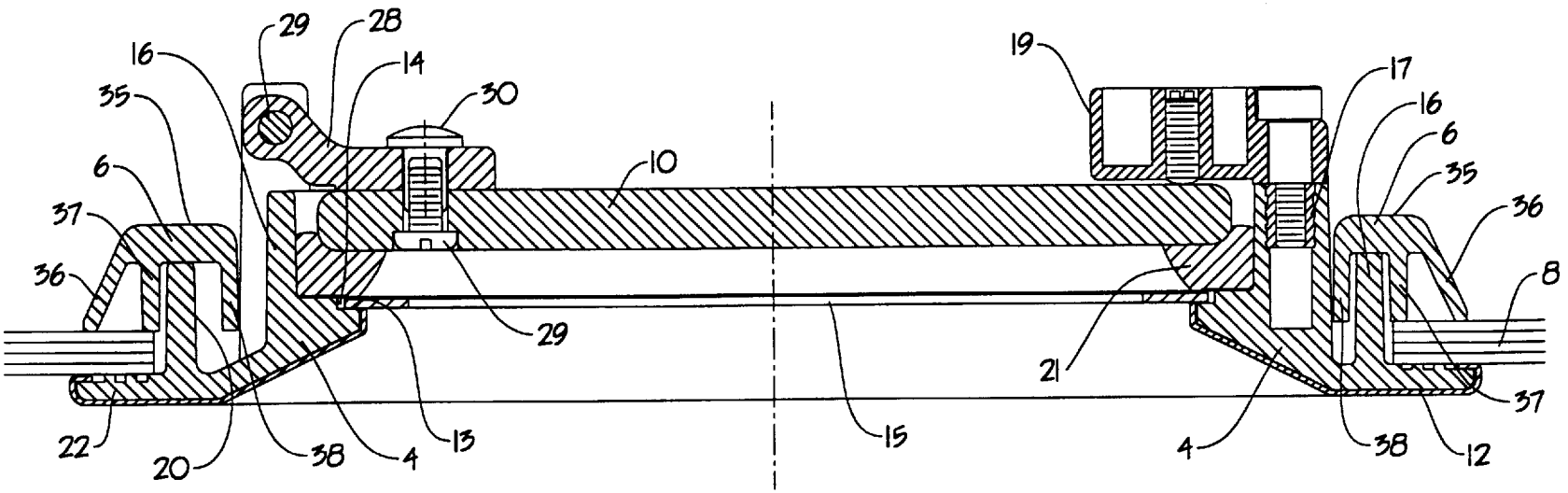
FIG. 2 is a cross-sectional view of the port assembly in accordance with a preferred embodiment of the invention taken along the line 2—2 in FIG. 1.
Figure 3:
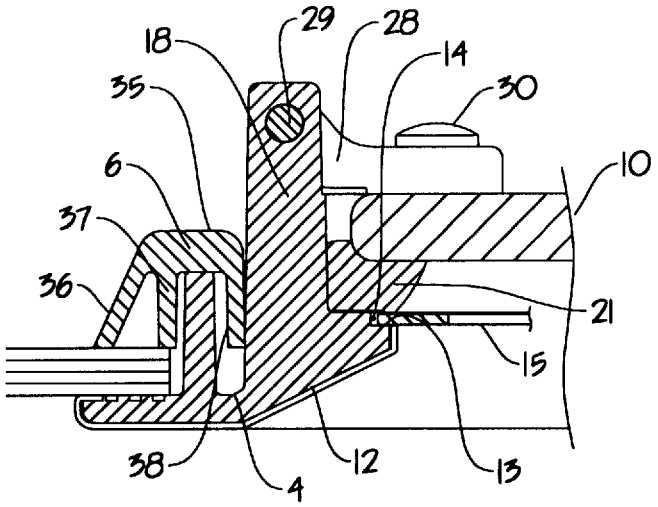
FIG. 3 is a cross-sectional view of the port assembly in accordance with the invention taken along the line 3—3 in FIG. 3.
Figure 4:
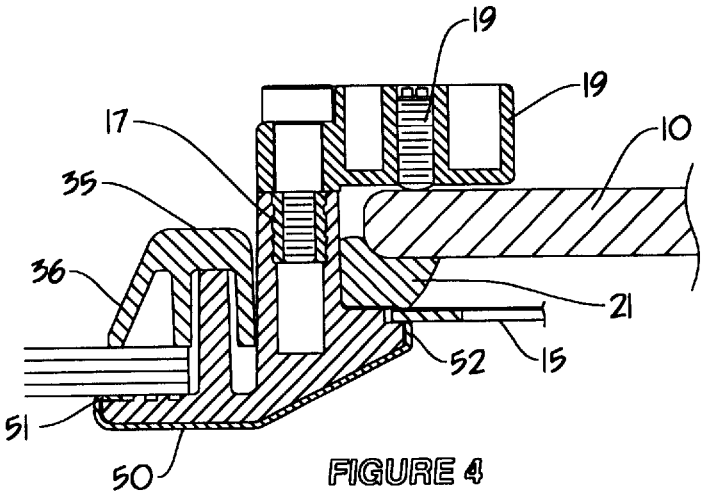
FIG. 4 is a cross-sectional view of the port assembly in accordance with the invention taken along the line 4—4 in FIG. 1.

As shown in FIGS. 1 and 2, a port assembly 2 for a marine vessel, or the like, includes first and second plastic members or rings 4 and 6 which are typically molded from ABS or other suitable plastic in a manner which will be well understood by those of ordinary skill in the art of plastic molding. The two rings are of sufficient thickness to provide the structural support for the port assembly but at the same time are sufficiently flexible to accommodate slight curvature and/or irregularities in the thickness in the vessel wall. In addition, the two rings are constructed and arranged to accommodate different wall thicknesses.

The assembly 2 also includes a lens element 10 which defines a generally ring shape such as a circle, oval, square or rectangle as are commonly used in boats, yachts and other marine vessels or the like. The lens element is typically made of LEXAN, or other suitable plastic and may be clear or tinted in accordance with an owner's preference.

The plastic rings 4 and 6 are arranged in a stacked or superimposed relationship with a first of the plastic rings 4 forming an outer or trim ring 12 on the outside of a hull or cabin wall 8. As illustrated, the ring 4 fits within an opening in the wall 8 of a vessel in an abutting and overlapping arrangement. The ring 4 may also include a recess 13 and shoulder 14 for receiving, positioning and maintaining a screen 15 within the port assembly 2.

The plastic ring 4 (s e e FIGS. 2–5) includes a first or inner inwardly projecting wall member or wall 16 which defines a shape which is essentially the same as but slightly larger than the shape of the lens element 10. To be more specific, the reference to inner wall is taken with respect to its proximity to the lens element 10, while inwardly projecting or extending refers to toward the interior of the vessel or cabin. The ring 4 also includes a pair of hinge brackets 18 which are formed adjacent to and abutting the wall 16. These brackets 18 are an integral part of the wall 16. For example, the wall 16 has a thickness of about ⅛ inch while the brackets which are molded therein and as part of the ring have a thickness of about 5⁄16 inch and a width of about ¼ inch.

The inner wall 16 also includes one or more and preferably 3 dog mounting elements 17 which are molded into the wall but extend outwardly therefrom along an outer surface of the wall 16. These mounting elements also included a threaded bore and are preferably flush with the top of the wall i.e., the inner most portion of the interior extending wall. A latch or dog 19 is pivotally mounted on each of the elements 17 by means of an allen set screw or the like and adapted to securely fasten the lens element in a closed position as will be described hereinafter.

A flexible gasket 21 fits within the opening defined by the inner wall 16 in an abutting relationship therewith. The gasket 21 is also in an abutting relationship with a shoulder 23 which is formed in the ring 4 adjacent to the wall 16 and is held in place by conventional means such as a suitable adhesive.

A hinge assembly 28 including a hinge pin 29 is rotatably fixed to brackets 18 and secured to the lens element 10 by mechanical fastening means such as one or more barrel nuts 29 and pan head machine screws 30.

In addition to the inner wall 16, the ring 4 also includes an outer wall 20 and a perpherial flange 22. This flange 22 preferably includes a ribbed surface and is pressed against a wall 8 to form a water tight seal therewith. The outer wall 20 also includes a plurality of threaded fastening elements 24 each of which has a threaded bore therein. The fastening elements 24 are adjacent to and abutting the outer wall 20 and preferably form an integral part thereof. The wall 20 also has a thickness of about ⅛" but includes enlarged portions which accommodate the threaded bores of the fastening elements 24. As illustrated, a plurality of fastening elements are spaced apart along the inner portion of the wall 20 i.e., they extend into the gap between the two walls. An outer surface of the inwardly extending wall 20 is sized to fit an opening in the wall 8 of the vessel.

The second plastic ring 6 has the same general shape as the ring 4 and is constructed and arranged or adapted to fit in a concentric somewhat nested relationship with the plastic ring 4, but on the opposite side of the wall 8 from the first plastic ring 4. In other words, the ring 6 forms an interior side of the port assembly 2 and acts as one half of a clamp which holds the port assembly 2 within the opening in the wall 8.

Figure 5:
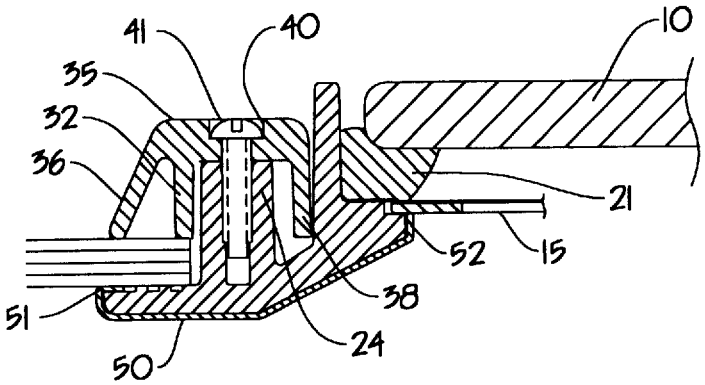
FIG. 5 is a cross-sectional view of the port assembly in accordance with the invention taken along the line 5—5 in FIG. 1.

In a preferred embodiment of the invention, the ring 6 has a generally flat inner surface 35 i.e., inner with respect to the vessel and three outwardly extending spaced apart walls 36, 37 and 38. The walls 37 and 38 are generally perpendicular to the surface 35 and generally parallel to one another, however, the wall 38 i.e., the inner wall with respect to the center of the lens element 10 includes a number of indentations which allow the ring to fit over the hinge 28 and dogs 19. The walls 37 and 38 also define an open channel or groove therebetween which is adapted to receive the wall 16 and fastening elements 24 (see FIG. 5) therein. The dogs 19 may also include an adjustment means such as a nylon screw 19' as shown in FIG. 5.

The ring 6 also includes a plurality of corresponding fasting elements 40 such as reinforced counter sunk openings which are aligned with the fastening elements 24 when the rings 4 and 6 are positioned in a stacked relationship with one ring on each side of the wall 8. These reinforced counter sunk openings comprise thicken wall portions surrounding each opening. A plurality of phillips head screws 41 are inserted through the openings and screwed into the threaded bores of elements 24 to clamp the port assembly 2 to the wall 8. The walls 36 and 37 engage i.e. are pressed tightly against the wall 8 and together with the ribbed flange 22 clamp the port assembly 2 in place in a wall of the vessel. The height of these walls and length of the screws are sufficient to accommodate different hull or cabin wall thicknesses while the rings themselves have sufficient flexibility to accommodate slight curvature or irregularities in a wall.

The preferred embodiment of the invention also includes another important feature. That feature resides in a recess 6' in a lower bottom portion of the ring 6 adjacent to the center dog 19. This recess 6' extends outwardly in both directions from the center dog 19 i.e. away from the center lower portion of the ring 6 and towards the other two dogs 19 which are at or near the side portions of the port assembly. This recess 6' eliminates the need for an inwardly directed knob or handle which extends inwardly into a cabin of the vessel. For example, if the center dog 19 rotates to the right in order to open the port, an individual can insert their fingers within a groove formed by the recess 6' on the left side of the center dog 19. Inserting the fingers into the groove allows the individual to engage the outer periphery of the lens element 10 in order to open the port. If the center dog 19 is rotated to the left, a groove in the right side of the dog is used.

Figure 6:
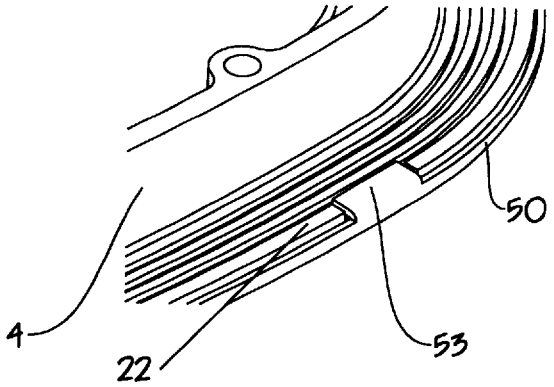
FIG. 6 is a schematic view illustrating the attachment of a decorative metal ring to one of the plastic rings in the port assembly in accordance with a preferred embodiment of the present invention.

In the preferred embodiment of the invention, a decorative metal ring 50 preferably of stainless steel fits over the outer surface of ring 4 in a nested relationship therewith. The metal ring 50 may be aluminum or chrome plated steel and presents a rich appearance from the exterior of the vessel. The metal ring 50 conforms to the outer surface of the ring 4 and includes an inwardly directed (toward the interior of the vessel) shallow wall 51 around its periphery and a similar inwardly directed shallow wall 52 about its inner edge. The walls 51 and 52 engage the wall 8 so that the entire surface of the ring 4 is fully covered. In essence, the height of the walls 51 and 52 is generally equal to the thickness of the flange 22. The ring 50 also includes a plurality of tabs 53 (see FIG. 6) which form a part of wall 51 but extends inwardly beyond the inner edge of the wall 51. These tabs are adapted to be folded over the ring 4 and fit within a slight recess of an inner surface of the flange 22 in a customary manner and hold the ring 50 tightly in place when the port assembly 2 is clamped to the wall 8.

While the invention has been described in connection with the preferred embodiments, it should be recognized and understood the changes and modifications may be made therein without departing from the scope of the appended claims.

What is claimed is:

1. A port assembly for a marine vessel having an outer wall with an opening therein, said port assembly comprising a shaped lens element and a first plastic ring surrounding said lens element and fitting within the opening in an abutting and overlapping relationship with the outer wall and forming an outer surface with respect to the vessel, said first plastic ring including an inwardly projecting wall member defining a shape which is similar to and slightly larger than the shape of said lens element, and a hinged bracket formed in said first plastic ring adjacent to said inwardly projecting wall member, a hinge mounted on said bracket and to said lens element to provide rotatable movement between said lens element and said first plastic ring and gasket means adjacent to said inwardly projecting wall member and between said first plastic ring and said lens element; and rotatable dog means for holding said lens element in sealing engagement with said gasket, a second plastic ring constructed and arranged to fit in a concentric stacked relationship with said first plastic ring and in an abutting relationship with an interior surface of the vessel wall, and fastening means for fastening said first and second plastic rings together in a clamping relationship with the wall of the vessel to thereby provide a port in the vessel.

2. A port assembly for a marine vessel in accordance with claim 1 in which said inwardly projecting wall member is formed integrally with said ring.

3. A port assembly for a marine vessel according to claim 2, in which said hinge bracket is integral with said first plastic ring and abutting said inwardly projecting wall member.

4. A port assembly according to claim 3, which includes a pair of hinge brackets.

5. A port assembly accordingly to claim 4, which includes a decorative metal ring superimposed on and covering the outer surface of said first plastic ring.

6. A port assembly according to claim 1 in which said second plastic ring includes a recess which allows an individual's fingers to engage an outer periphery of said lens element.

7. A port assembly for a marine vessel having an outer roll with an opening therein, said port assembly comprising a shaped lens elements and a first plastic ring surrounding said lens element and fitting within the opening in an abutting and overlapping relationship with the outer wall and forming an outer surface with respect to the vessel, said first plastic ring including a first inwardly projecting wall member, a pair of inwardly projecting hinge brackets formed in said first plastic ring adjacent to said first inwardly projecting wall member and a hinge element attached to said brackets and to said lens element providing for rotational movement between said lens element and said first plastic ring about said pivot and gasket means having the same general shape as said first inwardly projecting wall member and disposed adjacent said first inwardly projecting wall member and between said first plastic ring and said lens element, a mounting element formed integrally with said first plastic ring and adjacent to said first inwardly projecting wall and a rotatable dog disposed on said mounting element and constructed and arranged to hold said lens element in sealing engagement with said gasket when in a first position and for releasing said lens element for rotation about said hinge element when in a second position, said first plastic ring also including a second inwardly directed wall member spaced outwardly from said first inwardly directed wall member and a plurality of spaced apart fastening elements formed integrally with said first plastic ring and adjacent to said second inwardly directed wall member, a second plastic ring constructed and arranged to fit in a concentric nested relationship with said first plastic ring and in an abutting relationship with an interior surface of the wall, said second plastic ring defining a u-shaped cross section which is adapted to receive said second inwardly directing wall member of said first plastic ring disposed therein, said second plastic ring also including a plurality of corresponding fastening elements aligned with said spaced apart fastening elements in said first plastic ring and means including said plurality of spaced apart fastening elements in said first plastic ring and said corresponding fastening elements in said second plastic ring for fastening said first and second plastic rings together in a clamping relationship with the wall of the vessel.

8. A port assembly according to claim 7, which includes a decorative metal ring superimposed on and covering the outer surface of said first plastic ring.

9. A port assembly according to claim 8, which includes fastening elements having a threaded elements in said first plastic ring and in which the fastening element in said second plastic ring defines an opening.

10. A port assembly according to claim 7 in which said second plastic ring includes a recess adjacent to one of said dogs and in which said recess extends along said ring on both sides of said dog.

11. A port assembly for a marine vessel having an outer wall with an opening therein, said port assembly comprising a lens element and a first plastic ring surrounding said lens element and fitting within the opening in an abutting relationship with the wall and forming an outer surface with respect to the vessel, a second Plastic ring constructed and arranged to fit in a concentric relationship with said first plastic ring and in an abutting relationship with an interior surface of the vessel wall, means for fastening said first and second plastic rings together in a clamping relationship with the wall of the vessel and a decorative metal ring superimposed on and covering the outer surface of said first plastic ring, said decorative metal ring including an inwardly directed component for fitting around an outer periphery of said first plastic ring and a plurality of tabs for fastening said decorative metal ring to said first plastic ring.

12. A port assembly according to claim 11, in which said first plastic ring includes a plurality of recessed areas for receiving said tabs thereunder.

* * * * *

US005842433C1

(12) EX PARTE REEXAMINATION CERTIFICATE (5427th)

United States Patent
Kyle

(10) Number: US 5,842,433 C1
(45) Certificate Issued: Jun. 27, 2006

(54) PLASTIC PORT ASSEMBLY

(75) Inventor: James H. Kyle, Keene, NH (US)

(73) Assignee: Pompanette, Inc., Charlestown, NH (US)

Reexamination Request:
No. 90/006,579, Mar. 27, 2003
No. 90/006,975, Mar. 25, 2004

Reexamination Certificate for:

| | |
|---|---|
| Patent No.: | **5,842,433** |
| Issued: | **Dec. 1, 1998** |
| Appl. No.: | **08/926,478** |
| Filed: | **Sep. 10, 1997** |

(51) Int. Cl.
*B63B 19/00* (2006.01)

(52) U.S. Cl. ..... 114/173
(58) Field of Classification Search ..... None
See application file for complete search history.

(56) References Cited

U.S. PATENT DOCUMENTS

| | | | | |
|---|---|---|---|---|
| 1,815,940 A | | 7/1931 | Zoerner | |
| 4,669,410 A | * | 6/1987 | Howell | 114/173 |
| 4,976,212 A | | 12/1990 | Camarota | 114/178 |
| 5,758,593 A | | 6/1998 | Kyle | |
| 5,842,433 A | | 12/1998 | Kyle | |

OTHER PUBLICATIONS

Marinco Catalog 1997, p. 106, Napa California, Oct. 1996.*
Bomar 1988 Offshore Catalog.
1983–85 Boomsma Schweepvaart Catalog.
Vetus 1994 Catalog.
Bomar, 1991 Offshore Catalog, p. 35.
Boomsma Catalog, 1984–1985.
Bomar 1991 Offshore Catalogue.
Lewmar 1989 Hatch & Hardware Catalogue.
Lewmar 1994 Catalogue.
Vetus 1994 Catalogue.

* cited by examiner

*Primary Examiner*—Sherman Basinger

(57) ABSTRACT

A port assembly for a marine vessel having an outer wall with an opening therein includes a shaped lens element, a pair of concentric plastic rings and a resilient gasket between the lens element and one of the rings. The plastic ring on the outside of the vessel is adjacent to the gasket and includes a pair of hinged brackets and a plurality of mounting members. A hinge assembly connects the plastic ring and lens element and allows the lens to be rotated inwardly to an open position and back to a closed position in which it is pressed against a gasket. One or more dogs are rotatably mounted on the mounting members for holding the lens element in a closed position. The second plastic ring is constructed and arranged to clamp the first ring within the opening and against the wall of the vessel. In a preferred embodiment of the invention, a decorative metal ring covers the exterior surface of the port assembly.

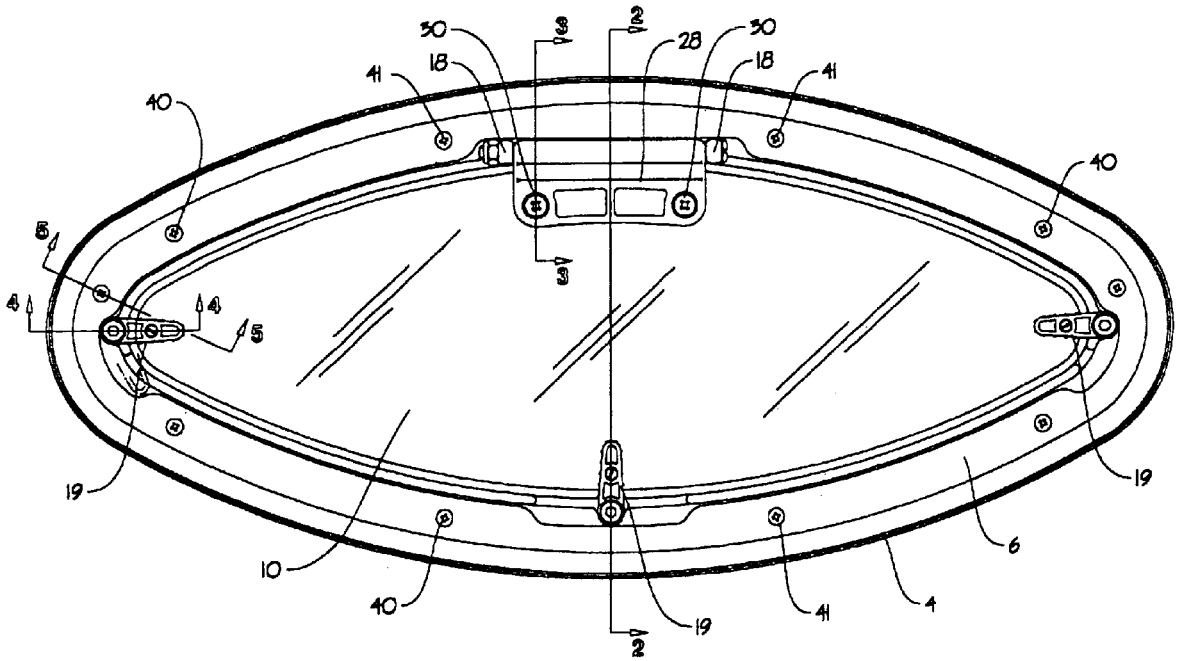

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, lines 43–55:

In a preferred embodiment of the invention, the ring 6 has a generally flat inner surface 35 i.e., inner with respect to the vessel and three outwardly extending spaced apart walls *or flanges* 36, 37 and 38. The walls of *or flanges* 37 and 38 are generally perpendicular to the surface 35 and generally parallel to one another, however, the wall *or flange* 38 i.e., the inner wall with respect to the center of the lens element 10 includes a number of indentations which allow the ring to fit over the hinge 28 and dogs 19. The walls *or flanges* 37 and 38 also define an open channel or groove therebetween which is adapted to receive the wall 16 and fastening elements 24 (see FIG. 5) therein. The dogs 19 may also include an adjustment means such as a nylon screw 19' as shown in FIG. 5.

AS A RESULT OF REEXAMINATION, IT HAS BEEN DETERMINED THAT:

Claims 1, 3, 5, 7, 9 and 11 are determined to be patentable as amended.

Claims 2, 4, 6, 8, 10 and 12, dependent on an amended claim, are determined to be patentable.

1. A port assembly for a marine vessel having an outer wall with an opening therein, said port assembly comprising a shaped lens element and a first plastic ring surrounding said lens element and fitting within the opening in an abutting and overlapping relationship with the outer wall and forming an outer surface with respect to the vessel, said first plastic ring including an inwardly projecting wall member defining a shape which is similar to and slightly larger than the shape of said lens element, and a [hinged] *hinge* bracket formed in said first plastic ring adjacent to said inwardly projecting wall member, a hinge mounted on said bracket and to said lens element to provide rotatable movement between said lens element and said first plastic ring and gasket means adjacent to said inwardly projecting wall member and between said first plastic ring and said lens element; and rotatable dog means for holding said lens element in sealing engagement with said gasket, a second plastic ring constructed and arranged to fit in a concentric stacked relationship with said first plastic ring and in an abutting relationship with an interior surface of the vessel wall, *said second plastic ring having a first inner surface on an interior side of said port assembly and a plurality of outwardly spaced apart generally parallel flanges extending toward said first plastic ring,* and fastening means for fastening said first and second plastic rings together in a clamping relationship with the wall of the vessel to thereby provide a port in the vessel.

3. A port assembly for a marine vessel according to claim 2, in which said hinge bracket is [integral with] *formed in* said first plastic ring and abutting said inwardly projecting wall member.

5. A port assembly [accordingly] *for a marine vessel according* to claim [4] *1*, which includes a decorative metal ring superimposed on and covering the outer surface of said first plastic ring.

7. A port assembly for a marine vessel having an outer [roll] *wall* with an opening therein, said port assembly comprising a shaped lens [elements] *element* and a first plastic ring surrounding said lens element and fitting within the opening in an abutting and overlapping relationship with the outer wall and forming an outer surface with respect to the vessel, said first plastic ring including a first inwardly projecting wall member, a pair of inwardly projecting hinge brackets formed in said first plastic ring adjacent to said first inwardly projecting wall member and a hinge element attached to said brackets and to said lens element providing for rotational movement between said lens element and said first plastic ring about said pivot and gasket means having the same general shape as said first inwardly projecting wall member and disposed adjacent said first inwardly projecting wall member and between said first plastic ring and said lens element, a mounting element formed integrally with said first plastic ring and adjacent to said first inwardly projecting wall and a rotatable dog disposed on said mounting element and constructed and arranged to hold said lens element in sealing engagement with said gasket when in a first position and for releasing said lens element for rotation about said hinge element when in a second position, said first plastic ring also including a second inwardly directed wall member spaced outwardly from said first inwardly directed wall member and a plurality of spaced apart fastening elements formed integrally with said first plastic ring and adjacent to said second inwardly directed wall member, a second plastic ring constructed and arranged to fit in a concentric nested relationship with said first plastic ring and in an abutting relationship with an interior surface of the wall, said second plastic ring defining a u-shaped cross section which is adapted to receive said second inwardly directing wall member of said first plastic ring disposed therein, said second plastic ring also including a plurality of corresponding fastening elements aligned with said spaced apart fastening elements in said first plastic ring and means including said plurality of spaced apart fastening elements in said first plastic ring and said corresponding fastening elements in said second plastic ring for fastening said first and second plastic rings together in a clamping relationship with the wall of the vessel.

9. A port assembly according to claim 8, which includes fastening elements having a threaded [elements] *element* in said first plastic ring and in which the fastening element in said second plastic ring defines an opening.

11. A port assembly [for a marine vessel having an outer wall with an opening therein, said port assembly comprising a lens element and a first plastic ring surrounding said lens element and fitting within the opening in an abutting relationship with the wall and forming an outer surface with respect to the vessel, a second Plastic ring constructed and arranged to fit in a concentric relationship with said first plastic ring and in an abutting relationship with an interior surface of the vessel wall, means for fastening said first and second plastic rings together in a clamping relationship with the wall of the vessel and] *according to claim 7 which includes* a decorative metal ring superimposed on and covering the outer surface of said first plastic ring, said decorative metal ring including an inwardly directed component for fitting around an outer periphery of said first plastic ring and a plurality of tabs for fastening said decorative metal ring to said first plastic ring.

* * * * *